United States Patent [19]

Kellner et al.

[11] 4,195,701

[45] Apr. 1, 1980

[54] RAISE DRILL HAVING WATER PASSAGES DIRECTED TOWARD THE ROLLER CUTTERS

[75] Inventors: Jackson M. Kellner; George A. Alther, both of Midland, Tex.

[73] Assignee: Smith International, Inc., Newport Beach, Calif.

[21] Appl. No.: 927,093

[22] Filed: Jul. 24, 1978

[51] Int. Cl.[2] ..... E21C 23/00

[52] U.S. Cl. ..... 175/340; 175/53; 175/344; 64/27 NM

[58] Field of Search ..... 175/53, 320, 321, 339, 175/340, 344, 393, 406; 267/137; 64/27 NM

[56] References Cited

U.S. PATENT DOCUMENTS

| | | | |
|---|---|---|---|
| 3,451,722 | 1/1969 | Scaravilli et al. | 175/320 X |
| 3,675,729 | 7/1922 | Neilson | 175/344 X |
| 3,746,330 | 7/1973 | Taciur | 267/137 |
| 3,947,009 | 3/1976 | Nelmark | 175/320 X |
| 3,968,843 | 7/1976 | Shotwell | 173/162 X |
| 4,007,799 | 2/1977 | Dixon et al. | 175/53 X |
| 4,018,291 | 4/1977 | Anderson | 173/139 X |
| 4,076,087 | 2/1978 | Chuply et al. | 175/53 X |
| 4,142,593 | 3/1979 | Dixon et al. | 175/53 |

*Primary Examiner*—Ernest R. Purser

*Assistant Examiner*—Nick A. Nichols, Jr.

*Attorney, Agent, or Firm*—Robert M. Vargo

[57] ABSTRACT

A raise bit is disclosed for enlarging a pilot hole into a large diameter hole by disintegrating the earth formations surrounding the pilot hole. The raise bit includes a removable drive stem for enabling the raise bit to be transported through small drifts. The drive stem is attached to a thrust bearing plate which, in turn, is interconnected to a main bit body. The bit body extends around the drive stem and includes a plurality of rolling cutters for contacting and disintegrating the earth formations surrounding the pilot hole. The interconnection between the thrust bearing plate and the bit body is accomplished by means of an annular shock absorbing ring made of polyurethane. Means are also provided to transport fluid from the interior of the drive stem to contact the rolling cutters on the bit body. These means comprise a fluid passage way extending through the interior of the drive stem. An additional passageway is provided in the drive stem to discharge the fluid radially out of the bottom end of the drive stem. Conduits are provided for communicating with the radial passageway of the drive stem. The conduits further extend through the annular ring, the bit body and through the cutter mountings to direct the fluid against the surfaces of the cutters.

6 Claims, 1 Drawing Figure

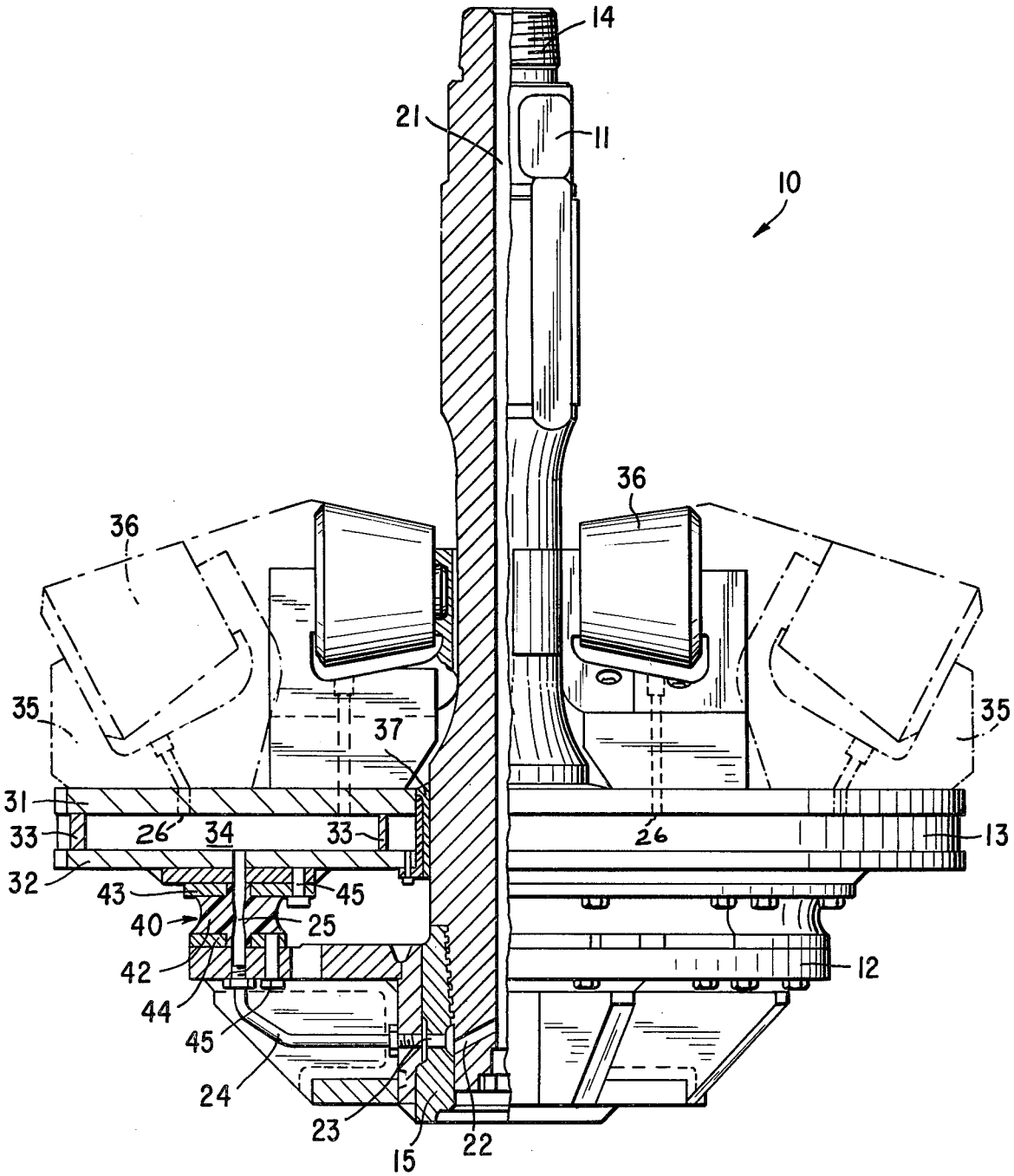
14
21
11
10
36
36
35
35
37
31
33
26
34
33
26
13
32
43
45
40
25
42
12
44
45
24
23
15
22

RAISE DRILL HAVING WATER PASSAGES DIRECTED TOWARD THE ROLLER CUTTERS

BACKGROUND OF THE INVENTION

1. Field of the Invention

The present invention relates generally to raise type boring drills and, more particularly, to means for cooling the rolling cutters of the drills.

2. Description of the Prior Art

A relatively large diameter hole may be provided between two locations in a mine by an operation commonly referred to as raise drilling. A raise drilling operation begins by drilling a small diameter pilot hole through the earth between the locations using a small diameter pilot bit. After the pilot hole is completed, the pilot bit is removed from the drill column and a large diameter raise bit is attached. The raise bit is then rotated and drawn along the pilot hole to enable the drill cutters to contact and disintegrate the earth formations surrounding the pilot hole, thereby enlarging the pilot hole to the desired size. In an exemplary embodiment, the pilot hole may be 11 inches in diameter and the reamed out hole may be six feet in diameter.

During a raise drilling operation, a tremendous amount of wear and stress is imposed upon the raise bit. The drive stem in particular is subjected to considerable wear due to abrasive contact with the surrounding earth formation and is also subject to considerable stress resulting from (a) tension due to the pulling force imparted to the drill, (b) twisting due to the torque applied to the drill, and (c) bending due to uneven loading around the circumference of the drill. For this reason it is preferable to have the drive stem removable from the drill bit body.

The advantages of having the drive stem removable are that the elements having a relatively short lifespan can be replaced, thereby extending the useful life of the bit, and the low profile of the separated components allows the raise bit to be transported through small drifts or passages.

The disadvantage of the replaceable drive stem is that a certain amount of down time is still required to remove and replace the stem. This non-operating time is costly and it is still preferable to obtain as long a running time as possible for each bit-stem combination.

One area that has not been sufficiently explored in raise drilling is the area relating to improving the operating life of a raise drill drive stem while still providing necessary structure for carrying out the normal functions of the raise drill. The present invention accomplishes this by providing a shock element in the drill for absorbing the uneven bending and impact loads on the bit, and by further providing fluid passages through the shock element in order to direct cooling fluid to the rolling cutters of the bit body.

SUMMARY OF THE INVENTION

In its broadest aspect, the present invention pertains to a raise-type drill comprising a drive stem attached to a thrust bearing support plate which, in turn, is interconnected to a main bit body having a plurality of rolling cutters mounted thereon. The interconnection is accomplished on an elastomeric shock element which functions to transfer the thrust and torsional loads from the drive stem to the bit body while absorbing the bending loads passing therethrough. A fluid passageway extends through the shock element to communicate through conduits with the interior of the drive stem and the outer surfaces of the rolling cutters.

The advantage of the present invention is that the shock element prevents the bending and impact loads acting on the bit from being transferred to the drive stem.

Another advantage of the present invention is that the shock element itself includes fluid passageways for transporting cooling fluid from the drive stem interior to the surfaces of the rolling cutters mounted on the bit body.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

BRIEF DESCRIPTION OF THE DRAWING

The FIGURE is an elevational view, partially in section of a raise drill utilizing an elastomeric element and the fluid cooling system of the present invention.

DESCRIPTION OF THE PREFERRED EMBODIMENT

Referring now to the drawing, the FIGURE illustrates a raise drill reaming head, generally indicated by arrow 10, comprising a drive stem 11, a thrust plate 12, and a bit body 13. The upper end of the drive stem 11 is provided with a tapered thread 14 which is adapted to be threaded into a standard drill string through which the raise drill 10 is driven.

The thrust plate 12 is integrally connected to a threaded member 15 which is removeably threaded to the lower end of the drive stem 11.

The bit body 13 is comprised mainly of a pair of parallel plates 31 and 32 rigidly secured to each other by a plurality of annular ribs 33 to form a frame. It should also be noted that a compartment 34 is formed by the above mentioned elements 31, 32 and 33.

The upper plate 31 has a plurality of saddles 35, some of which are shown in phantom, integrally mounted thereon for rotatively supporting a plurality of rolling cutters 36, some of which are also shown in phantom.

The bit body 13 further includes a central opening extending around the central shaft portion of the drive stem 11 for receiving an annular packing member 37 which is integrally connected to the plate 32. The thrust plate 12 and the bit body 13 are interconnected by means of an elastomeric element, generally indicated by arrow 40.

The elastomeric element 40 comprises a substantially toroidal element 42 coaxially positioned with respect to the drive stem 11. The toroidal element 42 is made of a polyurethane material which is sandwiched between a pair of plates 43 and 44 which are of a similar toroidal configuration. The toroidal element 42 is bonded to the plates 43 and 44 to form an integral unit. The plates 43 and 44 include a plurality of threaded bore holes which are adapted to receive a plurality of bolts 45 for connection to the thrust plate 12 and the plate 32 of the bit body 13.

In accordance with the present invention, means are provided to transport coolant, such as water, from the interior of the drive stem 11 to the area adjacent the cutters 36. Such means are described as follows. The drive stem 11 includes a central passage 21 along the axis thereof which communicates with the interior of the drill column for receiving the coolant. A radial conduit 22 is formed in the drive stem 11 at the lower end thereof which communicates with the central passageway 21. The conduit also communicates with a radial passageway 23 formed in the threaded member 15. The fluid passageway continues with an angled conduit 24 which communicates with a flexible conduit 25 extending through the plates 12 and 32 and the shock element 42. The flexible conduit 25 can be made of a thin walled metal tubular material or of a plastic or similar resilient material or, as shown, a hole through the elastomeric shock element. The flexible conduit 25 communicates with the chamber 34 which functions as a manifold for the coolant. Passageways 26 are provided to extend through the plate 31 and the saddles 35 to communicate with the manifold chamber 34. The other ends of the passageways are directed toward the respective cutters 36. The coolant passing through the aforementioned fluid conduit system is directed against the cutters 36 to (1) cool the cutters, (2) assist in flushing away the cuttings, and (3) keep the dust down in the operating area.

It should be noted that various modifications can be made to the assembly while still remaining within the purview of the following claims.

What is claimed is:

1. A drill for boring into earth formations comprising:

a drive stem having means at one end thereof for connecting to a drill string;

a bit body having a plurality of rolling cutters mounted thereon;

flexible means interconnected between said drive stem and said bit body for absorbing the impact and dynamic loads between the drive stem and the bit body and transferring the vertical thrust and the torque loads from the drive stem to the bit body, said flexible means comprising an annular elastomeric member; and means for directing fluid against the surfaces of the cutters, said fluid directing means including passage means extending through the annular elastomeric member.

2. The combination of claim 1 wherein said passage means is flexible.

3. The combination of claim 1 wherein said passage means is elastomeric.

4. The combination of claim 1 wherein said passage means communicates via a conduit with the interior of said drive stem.

5. The combination of claim 1 wherein said fluid directing means includes a chamber formed in said bit body functioning as a fluid manifold.

6. The combination of claim 5 further including passageways communicating said manifold compartment with said cutters.

* * * * *